United States Patent [19]

Moss et al.

[11] 4,190,179

[45] Feb. 26, 1980

[54] APPARATUS FOR STORING AND DISPENSING GENERALLY CYLINDRICAL PRODUCTS

[75] Inventors: Charles A. Moss, Lee's Summit, Mo.; Boley A. Andrews, Shawnee Mission, Kans.

[73] Assignee: The Vendo Company, Overland Park, Kans.

[21] Appl. No.: 948,376

[22] Filed: Oct. 4, 1978

[51] Int. Cl.[2] ..... G07F 11/30

[52] U.S. Cl. ..... 221/299

[58] Field of Search ..... 221/289, 298, 299, 300, 221/301, 296, 290–293

[56] References Cited

U.S. PATENT DOCUMENTS 3,357,537 12/1967 Ring ..... 221/298 X

*Primary Examiner*—Allen N. Knowles

*Attorney, Agent, or Firm*—Schmidt, Johnson, Hovey & Williams

[57] ABSTRACT

An improved article restraining and releasing mechanism is provided for product dispensing machines in which rollable products are supported in a row upon an inclined shelf and individually released from the lower end of the shelf. The mechanism employs a pair of spaced rotatable restraining and releasing structures mounted on a rotatable shaft offset from but extending in the same general direction as the path of movement of the products along the shelf. The mechanism is particularly adapted for improving the versatility of drawer type product venders to include a capacity for efficiently handling generally cylindrical products such as canned foods.

17 Claims, 13 Drawing Figures

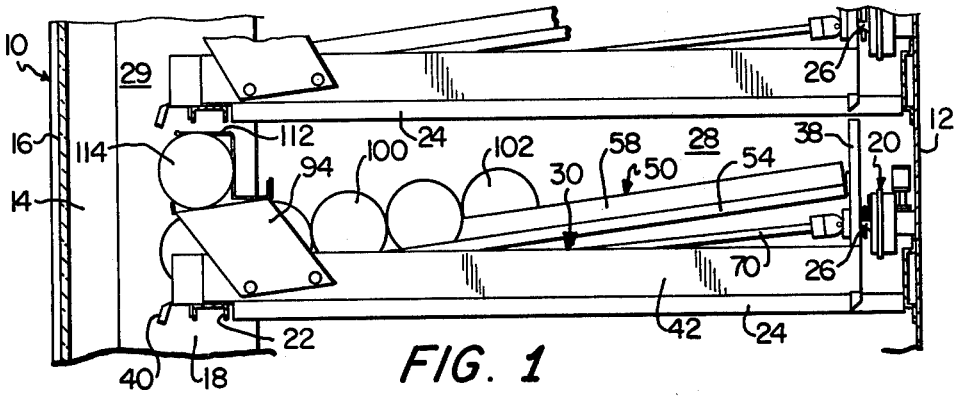
FIG. 1
FIG. 2
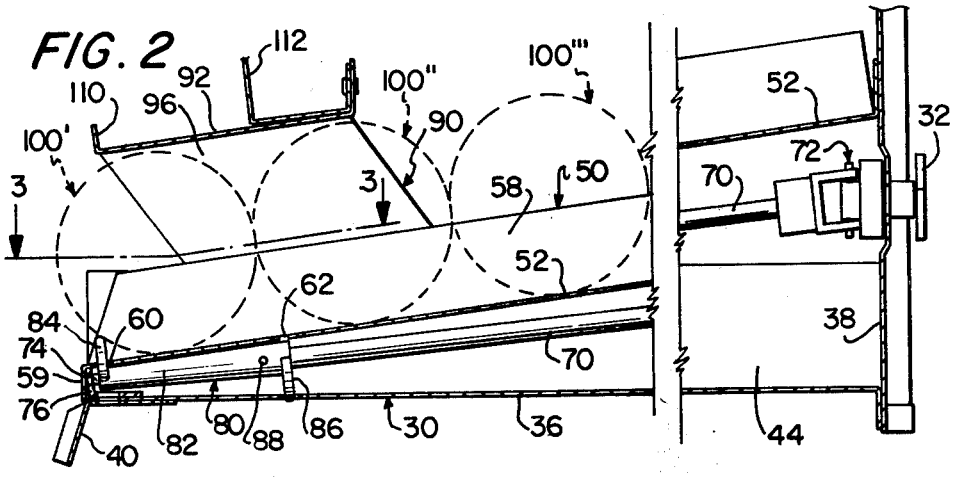
FIG. 3
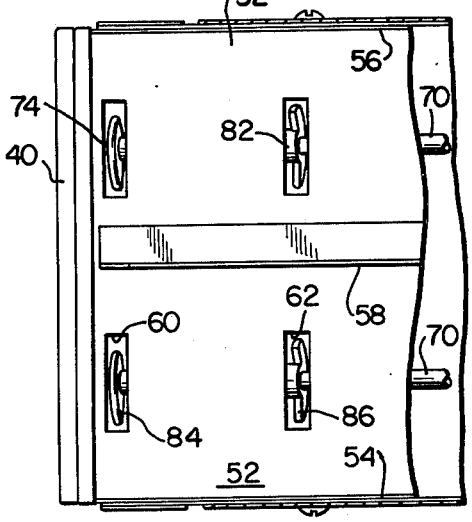
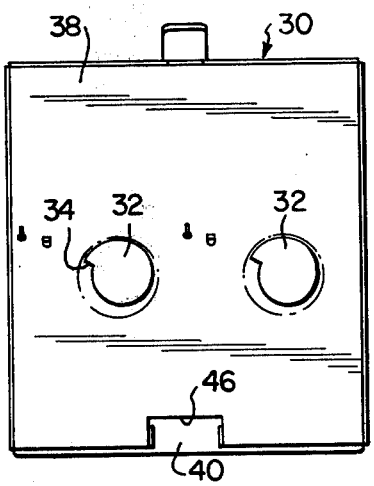
FIG. 4

APPARATUS FOR STORING AND DISPENSING GENERALLY CYLINDRICAL PRODUCTS

TECHNICAL FIELD

This invention relates to apparatus for storing and dispensing rollable products, such as vending machines for handling generally cylindrical or spherical articles.

The invention is particularly concerned with the improvement of the article restraining and releasing mechanism for dispensing apparatus of the type in which articles to be dispensed are rollably supported and stored in a row upon a shelf or the like, are urged toward one extremity of the shelf by inclining the latter or otherwise, and are adapted to be individually and successively dispensed by releasing the same for movement beyond one extremity of the shelf into a discharge path or zone for user access thereto.

In a still more specific context, our currently preferred embodiment, which is being disclosed in detail herein as illustrative of the invention, is concerned with providing such improved article restraining and releasing mechanism in conjunction with drawers having inclined shelves and otherwise particularly adapted for utilization on an exchangeable drawer basis within vending machines of the general class typically employing helical conveyor equipped drawers and disclosed, for example, in U.S. Pat. No. 3,653,540 or U.S. Pat. No. 3,737,071, reference also being made to U.S. Pat. Nos. 3,828,971, 3,840,147 and 4,043,483 as illustrative of other types of drawers for use in such machines.

BACKGROUND ART

From the broader viewpoint of the types of article restraining and releasing mechanisms which have heretofore been proposed or used with shelf type supports in apparatus for dispensing rollable products, it has long been recognized that some provision must be made, not only for normally restraining and then selectively releasing an end-most product for movement off of the shelf to dispense the same, but also for restraining the remaining products against movement off of the shelf while the end-most product is being dispensed. A variety of mechanisms have been suggested or employed for such purpose, including arrangements involving a pair of solenoid-operated shiftable stop elements spaced from each other along the path of products toward the delivery end of the shelf and appropriately controlled by linkages or separate solenoids, constructions involving rockable delivery cradles or rotatable paddle-wheel assemblies which block the path for the remaining products while delivering an end-most product, swingable gates having associated elements or surfaces for delivering one product while blocking the remainder, etc. Representative typical prior mechanisms of this general class are illustrated by U.S. Pat. Nos. 3,325,049, 3,348,733, 3,498,497, 3,540,562, 3,627,172, 3,627,174, 3,737,070 and 3,795,345. In general, however, although operable for the desired purpose, such prior mechanisms have been characterized from a manufacturing and functional standpoint by factors of undue complexity, multiplicity of components, need to provide unusually configured mechanical parts, complication of electrical control circuitry, and the like, with resultant adverse effects upon fabrication costs, operational reliability, or both. Moreover, such prior mechanisms have generally been characterized from a mechanical standpoint by the employment of shiftable elements which either pivot upon axes transverse to the path of products toward the discharge end of the shelf or are reciprocable in nature, thereby normally requiring the provision of driving components or linkages for controlling the shiftable elements at locations inconveniently adjacent the end of the shelf which is typically near the front of many vending machines.

From the more specific viewpoint of dispensing apparatus of the class illustrated in U.S. Pat. Nos. 3,653,540 and 3,737,071, in which supplies of a plurality of selectable products are respectively stored upon and dispensed from individual, preferably interchangeable, drawer-like assemblies, there has heretofore simply been no really satisfactory means proposed for efficiently storing and reliably dispensing rollable products such as generally cylindrical cans containing foods or the like. Since one of the virtues of such class of machines is their adaptability for handling and offering to the consumer a wide variety of packaged products on a selective basis from a single machine, the previous lack of suitable means for effectively handling cans or similar rollable products in such machines has constituted a serious limitation upon their otherwise versatile product-accommodating nature. The need for means to suitably handle canned products in such class of vending machines has recently become more acute for the purpose of satisfying the demands of consumers who desire to obtain from such a machine canned food products to be heated in a microwave oven or the like for consumption along with snack items of the types heretofore conventionally offered from such machines.

DISCLOSURE OF INVENTION

The improved article restraining and releasing mechanism provided by the invention employs a shelf or equivalent means for supporting a plurality of rollable articles to be dispensed for rolling movement toward a discharge end of the shelf under the influence of means such as inclination of the shelf itself, an asymmetric primary restraining element adjacent the discharge end of the shelf and rotatable about an axis offset from but extending generally in the direction of the path of movement of the articles to alternately protrude into and withdraw from such path a radially projecting part of the element, an asymmetric auxiliary restraining member spaced from the element to accommodate a single article therebetween and rotatable about an axis offset from but extending generally in the direction of the path of movement of the articles to alternately protrude into and withdraw from such path a radially projecting part of the member, and a rotatable shaft common to the element and the member and coupled therewith for simultaneously rotating them through respective sequential positions thereof for controlledly accomplishing the different phases of a dispensing cycle including the restraining of all articles in place on the shelf, the release of a single article from the discharge end of the shelf while restraining the remaining articles in place on the shelf, the restoration of restraint against any article moving off the the discharge end of the shelf and the release of the articles remaining on the shelf for advancement toward the discharge end thereof.

In the more specifically comprehensive aspect thereof, the invention provides an improvement for dispensing or vending machines of the general class referred to hereinabove, which involves incorporating our improved restraining and releasing mechanism, together with suitable shelf means, into a drawer assembly adapted for utilization on an interchangeable drawer basis within machines of such general class. In this context, it will become clear that our improved article restraining and releasing mechanism is ideally suited to permit accomplishment of related significant improvement of the machines themselves, by virtue of the adaptability of our improved mechanism for being accommodated within such machines both physically and from the standpoint of cooperation with the control and drive means typically employed in such machines, so as to require no modification of the machine itself other than substitution therein of one or more of the improved drawer assemblies provided by this invention for the handling of rollable type products.

BRIEF DESCRIPTION OF DRAWINGS

In the accompanying drawings:

FIG. 1 is a fragmentary, side elevational view of a portion of a product dispensing apparatus incorporating the currently preferred embodiment of our invention;

FIG. 2 is an enlarged, fragmentary, vertical cross-sectional view through the improved drawer assembly of our invention;

FIG. 3 is an enlarged, fragmentary, top plan view of a forward portion of the drawer assembly shown in FIG. 2, taken from the position indicated by line 3—3 in FIG. 2;

FIG. 4 is an enlarged, elevational view of the rear end of the drawer assembly shown in FIG. 2;

BEST MODE FOR CARRYING OUT THE INVENTION

Figure 5:
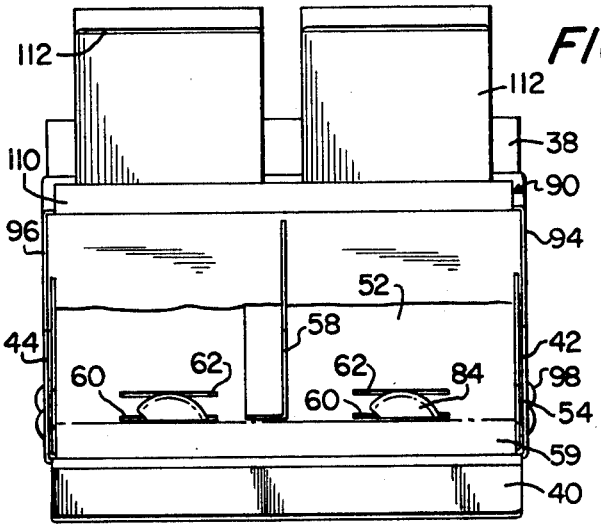
FIG. 5 is an enlarged, elevational view taken from the front end of the drawer assembly shown in FIG. 2.

Referring initially to FIG. 1, a dispensing or vending machine 10 of the general class disclosed in U.S. Pat. 3,653,540 and sometimes called helical conveyor drawer venders is represented by the portions thereof relevant to this invention, including a rear wall 12 forming a part of a cabinet further defined by a normally closed front door 14 having a transparent product viewing wall 16 and by suitable side wall and frame structures as at 18; a plurality of selectively actuatable drive assemblies 20 mounted on the rear wall 12 of the machine 10 in respective positions for alignment with the rear of a corresponding product storage and dispensing drawer of the type typicaly employed in such machines (or by this invention, as at 30) each of such assemblies 20 being adapted to automatically couple with a rotatable part on the rear of the drawer (such as 32 in the improved drawer 30 of this invention) when the drawer is fully inserted toward the rear of the interior of the machine 10 and to impart a turning force of typically one revolution to the rotatable part (32) on the drawer (30) whenever the assembly 20 is actuated; and drawer supporting structures including a transverse member 22 adjacent but spaced somewhat rearwardly from the door 14 for each level of drawers to be supported in the machine 10 and a rail member 24 extending forwardly from the rear wall 12 toward the appropriate transverse support member 22 for each drawer to be accommodated in the machine 10. Although the details of the assemblies 20 and the coupling between each assembly 20 and the rotatable part 32 on the rear of the corresponding drawer 30 are not material to this invention, aside from the rotational nature of the driving force to be imparted to the part 32, it is noted that the preferred form of assembly 20 is solenoid clutched to selectively revolve a forwardly extending tab 26 thereon, which is engageable with a cooperating shoulder 34 on the drawer carried part 32 to rotate the latter. For those not already familiar with this general class of machine 10, it may also be observed that the interior of the machine presents a chamber including a rearward major portion 28 and a thiner forward zone 29, with the rearward portion 28 presenting a substantial volume within which to receive and store supplies of articles to be dispensed and the structures for supporting and controllably releasing such articles, while the more forward zone 29 between the frontal extremities of the drawers 30 and the front wall 16 presents a discharge path for the gravitational movement of an article dispensed from the front of any drawer 30 of an access opening (not shown) conventionally provided in the lower portion of the front of the machine 10 from which a consumer may remove a dispensed article.

Referring now also to FIGS. 2, 3, 4 and 5, the preferred form of our improved drawer 30 is adapted for handling the storage and independent dispensing of side-by-side rows 100 and 102 of different specific kinds of products packaged in generally cylindrical, rollable cans such as are commonly used for packaging for individual servings of soups and other various food products, although those skilled in the art will appreciate that our drawers 30 may be equally well constructed and employed for handling only a single row of canned products in containers of presumably greater length, if desired. The preferred form of drawer 30 is front-to-rear elongate and includes a bottom wall 36, a rear panel 38 carrying a rotatable part 32 for each row of products to be handled, a downturned front lip 40 adjacent the front or discharge end of the drawer 30 and longitudinally extending side panels 42 and 44. The rear panel 38 is centrally notched along the bottom thereof as at 46 to receive the corresponding supporting rail member 24 for guiding the drawer 30 for proper coupling and uncoupling of each of the parts 32 with a corresponding assembly 20 during insertion and withdrawal of the drawer 30 relative to the storage chamber portion 28 as hereinafter explained. The drawer 30 is, of course, primarily supported by the engagement of the bottom wall 36 thereof atop the transverse member 22 and the rail member 24.

Mounted on the drawer 30 is an inclined shelf assembly generally designated 50, which includes an inclined longitudinal bottom wall 52 for rollably receiving the rows of articles 100 and 102 for movement toward the front and lower end of such bottom wall 52 from which they are to be individually dispensed into the discharge path zone 29 adjacent the front of the machine 10. The shelf assembly 50 further includes upturned side flanges 54 and 56 to provide outer guidance for the articles 100 and 102, a down-turned front wall 59, and an upstanding central partition 58 laterally dividing shelf assembly 50 into the side-by-side sections thereof for respectively receiving the rows of articles 100 and 102. The bottom wall 52 of the shelf assembly 50 is provided, for each row of products 100 or 102 to be supported thereon, with a lower clearance opening 60 adjacent the discharge end of the drawer 30 and an auxiliary clearance opening 62 spaced from the opening 60 in the direction away from the discharge end of the drawer 30 a distance preferably somewhat less than the diameter of the largest products to be handled.

An elongate, rotatable shaft 70 is suitably coupled, as by an universal coupler 72, at its rear end to each rotatable part 32 of the drawer 30 and extends forwardly therefrom beneath the bottom wall 52 of the shelf assembly 50 to adjacent the front end of the drawer 30 where a frontal shaft stub 74 of reduced diameter is journalled in a bracket 76 suitably mounted on the bottom wall 36 of the drawer 30.

Figure 6:
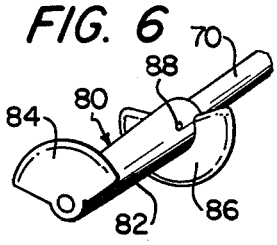
FIG. 6 is an enlarged, fragmentary, perspective view of the unitary rotatable assembly providing a primary restraining element and a secondary restraining member axially and circumferentially offset from the latter, together with a portion of the shaft upon which such assembly is mounted, which form a part of the improved article restraining and releasing mechanism utilized in the drawer assembly shown in FIG. 2.
Figure 7:
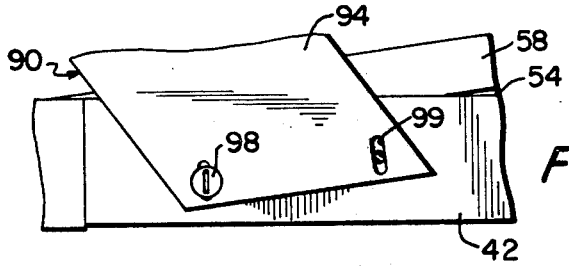
FIG. 7 is an enlarged, fragmentary, side elevational view of a portion of the drawer assembly shown in FIG. 2 specifically illustrating the adjustable mounting for an upper barrier and product displaying assembly located adjacent the front or discharge end of the drawer assembly.

Referring now also to FIG. 6, there is provided for each shaft an unitary assembly 80, which may be molded from plastic material, having a body portion 82, a frontal, radially extending segment of preferably somewhat less than 180° of arc presenting a primary restraining element 84, and a rearward, radially extending segment of preferably somewhat more than 180° of arc presenting an auxiliary restraining member 86 angularly offset approximately 180° from the element 84. The assembly 80 is mounted upon its shaft 70 adjacent the forward end of the latter for rotation therewith (and may be pinned thereto as at 88, if desired) with the assembly 80 located to dispose the element 84 and the member 86 in juxtaposition with the corresponding openings 60 and 62 for protruding upwardly therethrough or being withdrawn therebeneath as the shaft 70 is rotated.

Referring to FIG. 2, with the shaft 70 and assembly 80 in the rotational position illustrated, the primary restraining element 84 is protruding sufficiently upwardly through the clearance opening 60 to engage and restrain a next to be dispensed product 100' against movement off of the lower discharge end of the shelf surface 52, and, through successive interengagement thereof, the successively adjacent products 100'', 100''', etc. are in turn thereby restrained against rolling advancement toward the discharge end of the surface 52. In our preferred construction, however, we provide additional protection against any possibility of a product "jumping over" the primary restraining element 84 (or the auxiliary restraining member 86) in the form of an adjustable overhead barrier presented by the upper horizontal bight wall 92 of an inverted channel assembly 90 having down-turned side walls 94 and 96 respectively secured to the side walls 42 and 44 of the drawer 30, as by screws 98 passing through upright slots 99 in the side walls 94 and 96. The slots 99 permit the assembly 90 to be positioned so that, for products 100 of any particular diameter within a range of sizes to be handled, the distance from the shelf surface 52 to the barrier 92 will be slightly greater than the diameter of the products being handled, while the distance between the barrier 92 and an upwardly protruding restraining element 84 or restraining member 86 will be less than the diameter of the products.

Another feature of our preferred construction involves providing an up-turned flange 110 at the front of the bight wall 92 and a resilient rear and top clip 112 for holding a specimen product 114 in a display position atop the wall 92, as best shown in FIG. 1. This is useful since the label on the stationary specimen product 114 can be suitably arranged for consumer viewing, whereas the label on the front product 100' next to be dispensed may be turned to a less than optimum position for reading by a consumer through the transparent wall 16 during rolling of the product 100' down the shelf surface 52.

In the operation of the machine 10 incorporating our improvements, those familiar with such general class of apparatus will understand that any desired number of the improved drawers 30 may be substituted for some or all of the helical conveyor type drawers now typically employed in such machines merely by opening the door 14, removing the old drawers and inserting the rollable product handling drawers 30 of this invention, and will further understand that, with the door 14 opened, a serviceman may remove or partially slide the improved drawers 30 forwardly out of the storage chamber portion 28 to facilitate restocking with products.

Loading or stocking of the shelf surface 52 with products 100 by service personnel is facilitated by the adaptability of the drawer 30 to be either completely removed from the chamber 28, 29, loaded, then replaced, or to be slid forwardly upon the rail 24 and member 22 to extend through the zone 29 and out of the opened door 14 a substantial distance, in which latter condition it will be noted that engagement of the top of the rear wall 38 with the overlying rail 24 prevents excessive tipping of the extended drawer 30.

With a drawer 30 stocked with products 100 supported in a row upon the inclined shelf surface 52 and the drawer 30 inserted in operative disposition within the machine 10 as illustrated in FIG. 1, the relevant rotatable part 32 on the drawer 10 will be automatically coupled with the corresponding drive assembly 20 of the machine 10 for rotating the corresponding shaft 70 and unitary assembly 80 through one revolution upon each actuation of such assembly 20 responsive to product selection and coinage deposit (if required) by the consumer.

Although one of the other positions could conceivably be used for a standby condition of the shaft 70, assembly 80, element 84 and member 86 between actuations of the drive assembly 20, we prefer to employ the article advancement and restraining position illustrated in FIGS. 2 and 5 for that purpose. In such article advancement and restraining position, the auxiliary restraining member 86 is withdrawn beneath the opening 62 to permit the products 100 to all roll toward the opening 60 but the primary restraining element is protruding upwardly through the latter to engage the lowermost product 100' and thereby restrain all of the products 100 in a successively interengaged row thereof stretching upwardly along the inclined shelf surface 52.

Figure 8:
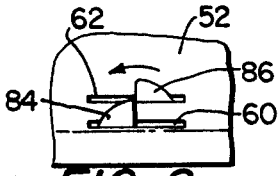
FIGS. 8–13 inclusive are diagrams illustrating the positions of the primary restraining element, the auxiliary restraining member and articles being handled during certain phases of an operating cycle hereinafter more fully described.
Figure 9:
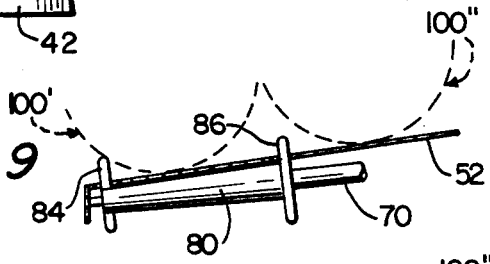

Upon actuation of the assembly 20, the shaft 70, assembly 80, element 84 and member 86 commence to rotate toward the auxiliary restraint effecting position shown in FIGS. 8 and 9, in which the primary restraining element 84, although rotated about 90° in the direction of the arrow in FIG. 8 from the standby condition thereof shown in FIGS. 2 and 6, still continues to protrude upwardly through the opening 60 into restraining engagement with the next-to-be-dispensed product 100', while the auxiliary restraining member 86 has moved into a position of upward protrusion through the opening 62 somewhat in front of the product 100" in readiness for restraining the latter upon release of the lowermost product 100'. It will be apparent that, with the preferred spacing between the element 84 and the member 86 chosen for handling larger diameter products 100 as illustrated in FIG. 9, the member 86 is not in this position actually engaging the product 100", but is ready to do so as soon as the product 100" is permitted to move slightly toward the discharge end of the shelf surface 52; with the same spacing, however, and products of a smaller diameter, it will be apparent that the product 100" may be still closer to or even engaging the auxiliary restraining member 86 when the latter is in this rotational position, although such is not necessary and undue spacing of the member 86 from the element will merely tend to waste valuable product storage space on the shelf surface 52.

Figure 10:
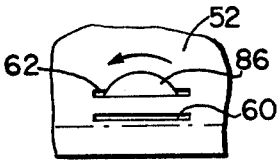
Figure 11:
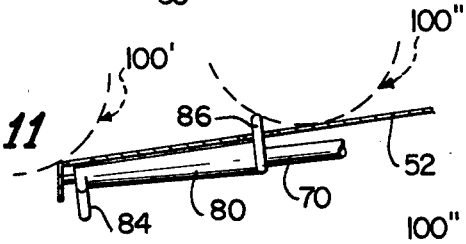

As the assembly 20 continues to rotate the shaft 70 approximately another 90° in the direction of the arrow in FIG. 8, the primary restraint removing and article releasing position shown in FIGS. 10 and 11 is reached, in which the primary restraining element 84 is withdrawn beneath the opening 60 to release the lowermost product 100' that is being dispensed by rolling off the discharge end of the shelf surface 52 into the discharge path zone 29, while the auxiliary restraining member 86 is fully protruding upwardly through the opening 62 and the product 100" has moved into restrained engagement therewith.

Figure 12:
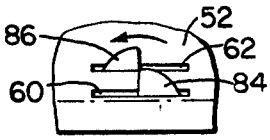
Figure 13:
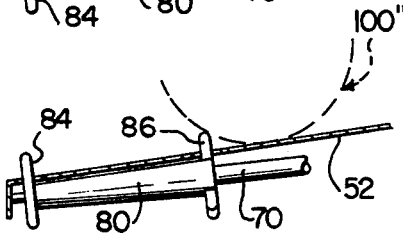

As the assembly 20 continues to rotate the shaft 70 another approximately 90°, the primary restraint restoring position shown in FIGS. 12 and 13 is reached, in which the auxiliary restraining member 86 continues to protrude upwardly through the opening 62 sufficiently to continue restraining the product 100" and those remaining products thereabove, while the primary restraining element 84 has moved into a position of upward protrusion through the opening 60 in readiness for engaging and restraining the product 100" when it is subsequently released to roll toward the discharge end of the shelf surface 52.

As the assembly 20 continues to rotate the shaft 70 a final approximately 90° to conclude the cycle, the standby or article advancement and restraining position shown in FIGS. 2 and 5 is restored, in which the auxiliary restraining member 86 is withdrawn below the opening 62 to permit all of the products 100 to roll toward the discharge end of the shelf surface 52 until the product 100" engages and is restrained by the fully protruding primary restraining element 84.

The surprising simplicity and resulting economy and reliability of the invention, as compared with the prior mechanisms commonly employed for similar purposes should now be manifest. It is recognized and contemplated, of course, that those skilled in the art may readily apply or adapt the invention to specific needs, such as accommodating the improved structure into various controlled temperature as well as ambient environments, employing various numbers of product row guiding structures and associated article restraining and releasing mechanisms on drawers of various sizes, providing a more trough-like configuration for shelf surfaces 52 intended to handle spherical products, forming the element 84 and the member 86 as separate assemblies if desired, adapting the improved restraining and releasing mechanism for use in differing types of shelf storage dispensing machines, and the like. Accordingly, the invention is intended to be limited only by the fair scope of the claims and to extend to all reasonable mechanical equivalents thereof.

INDUSTRIAL APPLICABILITY

The invention may be advantageously utilized in any apparatus for the dispensing or vending of rollable products from an end of a storage shelf toward which they are urged by gravity or equivalent means, and has particular utility when the improved article restraining and releasing mechanism of the invention is incorporated with inclined shelves into the drawers of machines of the general class disclosed in U.S. Pat. No. 3,653,540 to increase the range of products handleable by such machines to include general cylindrical or spherical articles.

Having thus described the invention, what is claimed as new and desired to be secured by Letters Patent is:

1. In a machine for dispensing articles of type adapted to roll upon a surface or revolution thereof:

article storage means for receiving and rollably supporting a plurality of said articles in a row aligned with the direction of rollability of said articles and for urging said articles into successively interengaging relationship with each other and toward one extremity of said storage means from which said articles are to be individually and successively dispensed upon movement thereof beyond said one extremity of said storage means;

shaft means rotatable through a plurality of rotational positions thereof including an article advancement and restraining position, an auxiliary restraint effecting position, a primary restraint removing and article releasing position, and a primary restraint restoring position;

a circumferentially asymmetric, primary restraining element disposed adjacent said one extremity of said storage means, operably coupled with said shaft means for rotation by the latter about an axis offset from but extending in substantially the same general direction as said row of articles, and configured and arranged for engaging and restraining a next to be dispensed article disposed at a location next adjacent said one extremity of said storage means against movement beyond the latter when said shaft means is in said article advancement and restraining, auxiliary restraint effecting, and primary restraint restoring positions thereof and for clearing said next to be dispensed article for movement beyond said one extremity of said storage means when said shaft means is in said primary restraint removing and article releasing position thereof; and a circumferentially asymmetric, auxiliary restraining member spaced from said element in a direction generally toward the opposite extremity of said storage means, operably coupled with said shaft means for rotation by the latter about an axis offset from but extending in substantially the same general direction as said row of articles, and configured and arranged for engaging and restraining an article disposed in said row next adjacent said location for said next to be dispensed article against movement into said location when said shaft means is in said auxiliary restraint effecting, primary restraint removing and article releasing, and primary restraint restoring positions thereof and for clearing said next adjacent article for movement into said location for said next to be dispensed article adjacent said one extremity of said storage means when said shaft means is in said article advancement and restraining position thereof, whereby said member will be disposed in a disposition out of engagement and restraining relationship to any of said articles, all of said articles will roll toward said one extremity of said storage means and a next to be dispensed article will occupy said location next adjacent said one extremity of said storage means and be engaged and restrained by said element against movement beyond said one extremity of said storage means when said shaft means is in said article advancement and restraining position thereof, said member will engage and restrain an article disposed in said row next adjacent said location when said shaft means is in said auxiliary restraint effecting position thereof, said element will be cleared out of restraining engagement with said next to be dispensed article to release the latter for movement beyond said one extremity of said storage means while said member continues to engage and restrain an article in said row next adjacent said location when said shaft means is in said primary restraint removing and article releasing position thereof, and said element will be moved when said shaft means is in said primary restraint restoring position thereof into a disposition for engaging and restraining said article disposed in said row next adjacent said location upon movement of same into said location when said shaft means is next in its article advancement and restraining position.

2. The invention of claim 1, wherein:

said element and said member are mounted on said shaft means for rotation therewith.

3. The invention of claim 2, wherein:

said element and said member comprise circumferentially and axially offset, radial extensions upon a unitary assembly mounted upon said shaft means for rotation therewith.

4. The invention of claim 1, wherein:

said storage means includes an inclined shelf upon which said articles are rollably supported.

5. The invention of claim 4, wherein:

said shelf is provided with openings for clearing said element and said member respectively, and said element and said member are respectively disposed beneath said openings and adapted to extend upwardly therethrough when said shaft means is in certain of said positions thereof.

6. The invention of claim 5, wherein:

said element and said member are mounted on said shaft means for rotation therewith.

7. The invention of claim 6, wherein:

said element and said member comprise circumferentially and axially offset, radial extensions upon a unitary assembly mounted upon said shaft means for rotation therewith.

8. The invention of claim 1, wherein:

there is provided a barrier juxtaposed above said element and spaced from the latter a distance greater than the diameter of said surface of said articles when said shaft means is in said primary restraint removing and article releasing position thereof and less than said diameter when said shaft means is in each of the other of said positions thereof.

9. The invention of claim 8, wherein:

said barrier is adjustably mounted on said storage means to permit altering said spacing of said barrier from said element for accomodating articles having various diameters.

10. The invention of claim 1, wherein:

said machine further includes cabinet means having a rear wall, a frontal door and a chamber therebetween including a rearward portion for the storage of articles to be dispensed and a forward zone presenting a discharge path for articles released from said rearward portion;

selectively actuatable, rotatable drive means on said rear wall;

drawer means having front and rear ends and provided with a rotatable part at the rear end thereof; and support means within said cabinet means for supporting said drawer means in an operating position with its front end disposed adjacent the rear of said zone and its rear end disposed adjacent said rear wall with said rotatable part operably coupled with said drive means, said storage means, shaft means, element and member being carried by said drawer means, said shaft means being operably coupled with said rotatable part.

11. The invention of claim 10, wherein:

said drawer means is releasably supported by said support means for emplacement thereon and removal therefrom and is shiftably supported when emplaced thereon for movement between said operating position and a loading position in which, with said door opened, a substantial portion of said drawer means is extended through said zone and forwardly out of said chamber.

12. The invention of claim 10, wherein:

said storage means includes an inclined shelf mounted on said drawer means and sloping downwardly toward the front end of the latter for shiftably receiving a row of rollable articles to be dispensed.

13. The invention of claim 12, wherein:

said element and said member are mounted on said shaft means for rotation therewith.

14. The invention of claim 13, wherein:

said element and said member comprise circumferentially and axially offset, radial extensions upon a unitary assembly mounted upon said shaft means for rotation therewith.

15. The invention of claim 14, wherein:

said shelf is provided with openings for clearing said element and said member respectively. and said element and said member are respectively disposed beneath said openings and adapted to extend upwardly therethrough when said shaft means is in certain of said positions thereof.

16. The invention of claim 15, wherein:

there is provided a barrier mounted on said drawer means and juxtaposed above said element and said member, said barrier being adjustably mounted for positioning thereof a distance above said shelf greater than the diameter of said surface of the articles to be handled and a distance above said element and said member less than the diameter of said surface of said articles when said element and said member are in article restraining positions thereof.

17. The invention of claim 16, wherein:

there is provided means mounted on said barrier for supporting a specimen article to be displayed, a portion of said door in front of the location for said specimen article being transparent to permit viewing thereof by consumers.

* * * * *